US006623628B1

(12) United States Patent
Bronner et al.

(10) Patent No.: US 6,623,628 B1
(45) Date of Patent: Sep. 23, 2003

(54) PROCESS FOR HYDROTREATING A MIDDLE DISTILLATE IN TWO SUCCESSIVE ZONES COMPRISING AN INTERMEDIATE ZONE FOR STRIPPING EFFLUENT FROM THE FIRST ZONE WITH CONDENSATION OF THE HEAVY PRODUCTS LEAVING OVERHEAD FROM THE STRIPPER

(75) Inventors: Charles Bronner, Irigny (FR); Gérald Heinrich, Saint Germain en Laye (FR); Cécile Plain, Saint Germain en Laye (FR); Laurence Carpot, Vernaison (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 283 days.

(21) Appl. No.: 09/604,060

(22) Filed: Jun. 26, 2000

(30) Foreign Application Priority Data

Jun. 25, 1999 (FR) ..... 99 08277

(51) Int. Cl.[7] ..... C10G 45/00

(52) U.S. Cl. ..... 208/210; 208/213; 208/217; 208/216 R; 208/89; 208/58; 208/59

(58) Field of Search ..... 208/210, 213, 208/217, 216 R, 89, 58, 59

(56) References Cited

U.S. PATENT DOCUMENTS

| | | | | | |
|---|---|---|---|---|---|
| 3,788,976 | A | * | 1/1974 | Kirk, Jr. | 208/89 |
| 4,954,241 | A | * | 9/1990 | Kukes et al. | 208/59 |
| 5,110,444 | A | * | 5/1992 | Haun et al. | 208/89 |
| 5,114,562 | A | | 5/1992 | Haun et al. | 208/89 |
| 5,498,810 | A | * | 3/1996 | Bogdan et al. | 585/310 |
| 5,705,052 | A | * | 1/1998 | Gupta | 208/57 |
| 5,846,405 | A | * | 12/1998 | Aldous et al. | 208/211 |
| 5,948,243 | A | * | 9/1999 | Kallenbach | 208/216 R |
| 5,986,154 | A | * | 11/1999 | Mignard et al. | 585/269 |
| 6,024,864 | A | * | 2/2000 | Aldous et al. | 208/212 |
| 6,036,844 | A | * | 3/2000 | Gupta et al. | 208/49 |

FOREIGN PATENT DOCUMENTS

EP 0 849 350 A1 6/1998

* cited by examiner

*Primary Examiner*—Nadine G. Norton
(74) *Attorney, Agent, or Firm*—Millen, White, Zelano & Branigan, P.C.

(57) ABSTRACT

A process for hydrotreating a hydrocarbon feed includes passing the feed into a hydrodesulphurization zone along with hydrogen, where a partially desulphurized effluent is sent to a stripping zone in which it is purified by at least one hydrogen-containing gas under conditions in which a gaseous stripping effluent containing hydrogen and hydrogen sulphide is formed along with a liquid effluent containing substantially no hydrogen sulphide.

20 Claims, 3 Drawing Sheets

Figure 1:
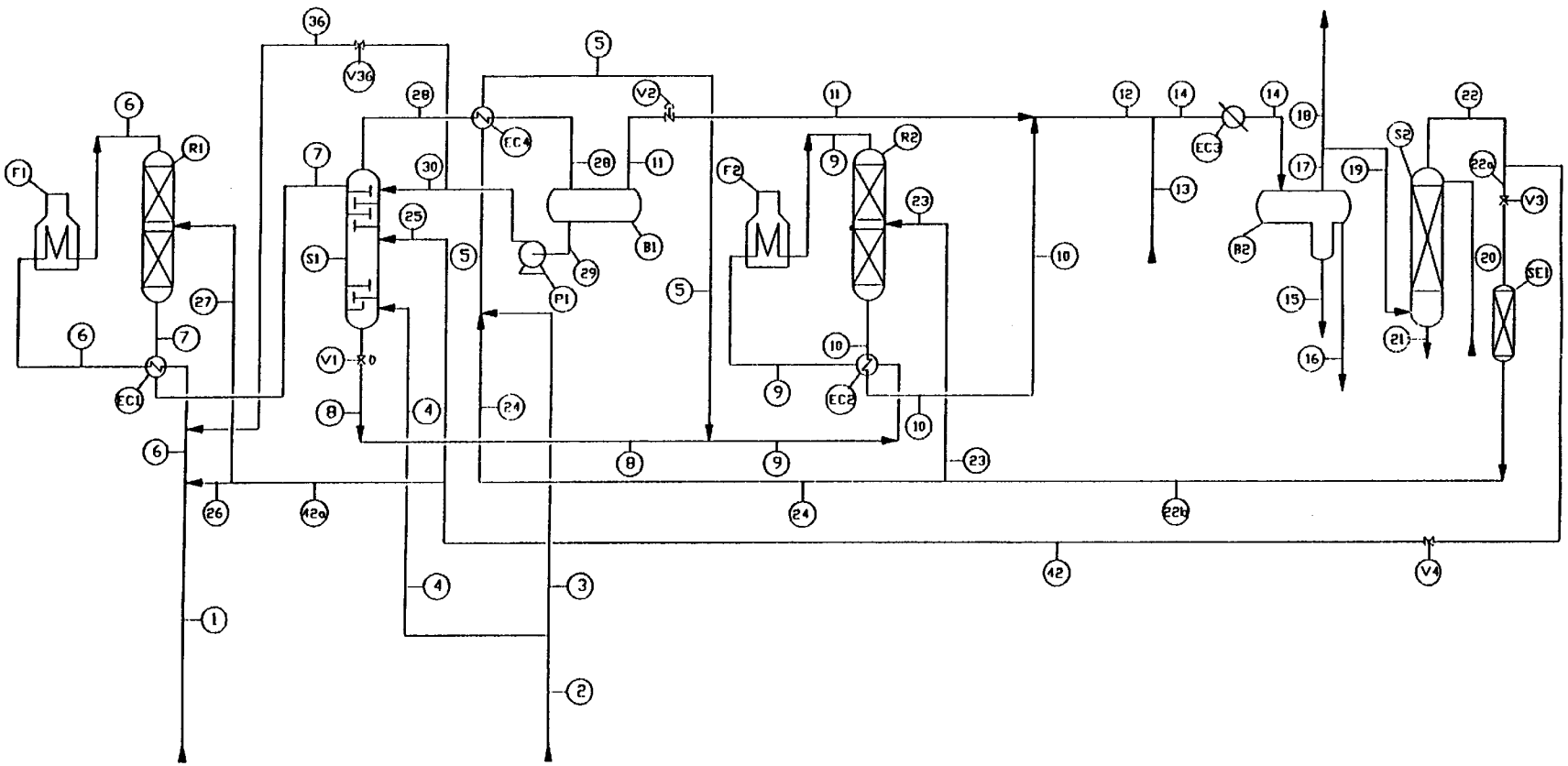

PROCESS FOR HYDROTREATING A MIDDLE DISTILLATE IN TWO SUCCESSIVE ZONES COMPRISING AN INTERMEDIATE ZONE FOR STRIPPING EFFLUENT FROM THE FIRST ZONE WITH CONDENSATION OF THE HEAVY PRODUCTS LEAVING OVERHEAD FROM THE STRIPPER

The present invention relates to hydrotreatment of hydrocarbon fractions, for example middle distillates, to produce hydrocarbon fractions with a low sulphur, nitrogen and aromatic compound content particularly for use in the field of internal combustion engine fuels. These hydrocarbon fractions include jet fuel, diesel fuel, kerosine and gas oils. More particularly, the invention relates to the production of a fuel for a compression ignition engine. In this field, the invention relates to a process for transforming a middle distillate and more particularly a gas oil cut to produce a dearomatised and desulphurised fuel with a high cetane number.

Currently, gas oil cuts, whether derived from straight run distillation of a crude or from a catalytic cracking process, still contain non-negligible quantities of aromatic compounds, nitrogen-containing compounds and sulphur-containing compounds. The current legislation of the majority of industrialised countries requires that the fuel for use in engines must contain a quantity of sulphur of less than about 500 parts per million by weight (ppm). In the vast majority of these countries, there are no current regulations imposing a maximum content for aromatic compounds and for nitrogen. However, a few countries or states, like Sweden and California, are envisaging limiting the aromatics content to a value of less than 20% by volume or even less than 10% by volume, and some experts even believe that this content could be limited to 5% by volume. In Sweden in particular, some classes of diesel fuel already have to comply with very strict specifications. Thus in that country, class II diesel fuel must not contain more than 50 ppm of sulphur and more than 10% by volume of aromatic compounds, and class I diesel must not contain more than 10 ppm of sulphur and 5% by volume of aromatic compounds. In Sweden at the moment, class III diesel fuel must contain less than 500 ppm of sulphur and less than 25% by volume of aromatic compounds. Similar limits are also in force for the sale of that type of fuel in California.

Meanwhile, motorists in a number of countries have been pressing for legislation obliging refiners to produce and sell a fuel with a cetane number of a minimum value. Current French legislation requires a minimum cetane number of 49, but in the near future this minimum value will be at least 50 (as is already the case for class I fuel in Sweden), probably at least 55, and most probably 55 to 65.

A number of specialists seriously envisage the future possibility of having a standard imposed on the nitrogen content of less than about 200 ppm, for example, and quite possibly less than 100 ppm. A low nitrogen content can result in better stability of the products and will be of general interest both to the vendor and to the manufacturer.

Thus it is necessary to develop a reliable and effective process for producing a product with improved characteristics both as regards the cetane number and as regards the aromatic compound, sulphur and nitrogen contents from conventional straight run gas oil cuts or from catalytically cracked gas oil cuts (LCO cut) or from another conversion process (coking, visbreaking, residue hydroconversion, etc.). It is particularly important, and this constitutes one of the advantages of the process of the present invention, to produce a minimum of gaseous hydrocarbon compounds so as to obtain an effluent which is directly and integrally useable as a very high quality fuel cut. Further, the process of the present invention can allow production over a long period and without the need for regenerating the catalysts used, which has the advantage of being stable over time. Further, in one implementation of the invention a further advantage resides in the hydrogen recycle. In this implementation, only a fraction of the hydrogen-containing gas is sent to a drying-desulphurising zone before being recycled, enabling the size of the dryer-desulphuriser to be reduced along with the quantity of material required to carry out this operation. In a further variation of the invention, the unit start-up is facilitated when using a furnace to adjust the temperature of the feed entering the second reactor.

U.S. Pat. No. 5,114,562 describes a process for hydrotreating a middle distillate in at least two consecutive steps to produce desulphurised and dearomatised hydrocarbon cuts, comprising a first hydrodesulphurisation step from which the effluent is sent to a hydrogen stripping zone to eliminate the hydrogen sulphide it contains, then the desulphurised liquid fraction obtained is sent to a second, hydrogenation, zone comprising at least two reactors operating in series in which the aromatic compounds are hydrogenated. In this disclosure, the hydrogen used in the stripping zone is makeup hydrogen which has to be added to the process, and after condensation by cooling, the hydrocarbon compounds entrained during stripping are re-introduced into the first hydrodesulphurisation step. The gas separated from the hydrocarbon compounds in the condensation step is treated by washing with an amine solution to eliminate the hydrogen sulphide it contains and is then sent to the second, hydrogenation, zone, then the effluent leaving the hydrogenation zone is separated into a desired liquid fraction and a gaseous fraction which is sent as a mixture with fresh feed to the inlet to the first hydrodesulphurisation step. This mode of operating has a number of disadvantages. Thus the hydrocarbons entrained at the head of the stripper, which are light compounds and which are recycled to the hydrodesulphurisation step, vaporise in this step and thus cause a reduction in the partial pressure of the hydrogen which is not favourable to good hydrodesulphurisation. A further disadvantage is the necessity of having a recycling pump which increases the cost of the equipment and the running costs.

U.S. Pat. No. 5,110,444 describes a process comprising hydrotreatment of a middle distillate in at least three distinct steps. The effluent from the first hydrodesulphurisation step is sent to a hydrogen stripping zone to eliminate the hydrogen sulphide it contains, then the desulphurised liquid fraction obtained is sent to a first hydrogenation zone the effluent from which is sent to a second stripping zone which is distinct from the stripping zone following the hydrodesulphurisation zone. Finally, the liquid portion from the second stripping zone is sent to a second hydrogenation zone. The light hydrocarbons entrained overhead from the first hydrogen stripper are recycled to the hydrodesulphurisation step which is deleterious to the efficiency of this step since in vaporising, these compounds reduce the partial pressure of the hydrogen. Further, this recycling involves the obligatory use of a recycling compressor which increases the equipment costs and the running costs.

The present invention presents a solution which can largely overcome the disadvantages of prior art processes. However, the disclosure of the prior art and in particular that of the documents cited in the text of the present invention form an integral part of the knowledge of the skilled person and all of the features must be considered to be included in the present description.

In its broadest scope, the present invention thus concerns a process for hydrotreating a hydrocarbon fraction such as a middle distillate, and in particular for transforming a gas oil cut to produce a high cetane number, dearomatised and desulphurised fuel in at least two successive steps. It also concerns the fuel obtained by said process. In the present description, the term "middle distillate" designates hydrocarbon fractions boiling in the range about 130° C. to about 385° C., normally in the range about 140° C. to about 375° C. and usually in the range about 150° C. to about 370° C., determined using the appropriate ASTM method. The process of the present invention is also of application in the treatment of hydrocarbon fractions with a boiling point in the naphtha range. This process can be used to produce hydrocarbon cuts for use as a solvent, as an additive or as fuels preferably with a reduced aromatic compound content. The term "kerosine" as used in the present invention designates a hydrocarbon fraction boiling in the range 130° C. to 250° C. The term "diesel fuel" as used in the present description means a hydrocarbon fraction boiling in the range 230° C. to 385° C. The term "naphtha" as used in the present description designates a hydrocarbon fraction from C5 to the endpoint of about 210° C. The term "gas oil" as used in the present description designates a hydrocarbon fraction boiling in the range 230° C. to 420° C. or heavier fractions boiling in the range 420° C. to 525° C. The term "jet fuel" as used in the present description designates a hydrocarbon fraction boiling in the range 130° C. to 290° C. The hydrocarbon fraction which is preferably used in the present process is a fraction with an initial boiling point of more than about 150° C. and with a boiling point for 90% of the distilled fraction, which is usually less than about 370° C. This fraction normally contains nitrogen in the form of organonitrogen compounds in a quantity which is usually about 1 ppm to about 1% by weight. It also contains sulphur in the form of sulphur-containing organic compounds in a quantity which is normally more than about 0.1% by weight and usually about 0.15% to about 5% by weight, usually about 0.5% to about 3.5% by weight. The amount of mono and/or polynuclear aromatic compounds is normally more than 10% by volume and usually more than 20% by volume, normally less than about 60% by volume and usually less than about 50% by volume.

More precisely, the present invention provides a process for hydrotreating a hydrocarbon feed containing sulphur-containing compounds, nitrogen-containing compounds and aromatic compounds, comprising the following steps:

a) at least one first step in which said feed and hydrogen are passed into a hydrodesulphurisation zone containing at least one hydrodesulphurisation catalyst comprising, on a mineral support, at least one metal or compound of a metal from group VIB of the periodic table and at least one metal or compound of a metal from group VIII of said periodic table, said zone being maintained under hydrodesulphurisation conditions including a temperature of about 260° C. to about 450° C. and a pressure of about 2 MPa to about 20 MPa;

b) at least one second step in which the partially desulphurised feed from the first hydrodesulphurisation step is sent to a stripping zone in which it is purified by stripping with a counter-current of at least one gas containing hydrogen at a pressure substantially identical to that prevailing in the first step and at a temperature of about 100° C. to about 350° C. under conditions for formation of a gaseous stripping effluent containing hydrogen and hydrogen sulphide and a liquid effluent containing substantially no more hydrogen sulphide;

c) at least one third step in which, after adding substantially pure makeup hydrogen and usually recycled hydrogen, the liquid feed from the stripping step is sent to a hydrotreatment zone containing a hydrotreatment catalyst comprising, on a mineral support, at least one noble metal or compound of a noble metal, preferably from group VIII. After bringing it to a temperature of about 220° C. to about 360° C. and a pressure of about 2 MPa to about 20 MPa in said zone by direct heat exchange, this effluent is maintained under hydrotreatment conditions to obtain a partially dearomatised effluent; said process being characterized in that the gaseous effluent formed in the stripping step, containing hydrocarbons which are gaseous under the conditions in said stripping zone, hydrogen and hydrogen sulphide, is cooled to a temperature which is sufficient to form a liquid hydrocarbon fraction which is sent to the stripping zone, and a gaseous fraction which is depleted in hydrocarbons which is sent to a zone for eliminating the hydrogen sulphide it contains and from which purified hydrogen is recovered.

The present invention also concerns the partially desulphurised and partially dearomatised hydrocarbon fraction obtained using the process of the invention.

A variety of implementations of the present invention can be realised, either separately from each other or in combinations. In an advantageous implementation, the stripping gas is a fraction of the makeup hydrogen used in the process of the invention. This fraction of makeup hydrogen normally represents less than 90% by volume of the total volume of makeup hydrogen used in the process, usually less than 60% and more usually about 1% to about 50%.

In a particular implementation of the invention, at least a portion of purified hydrogen recovered from the zone for eliminating hydrogen sulphide contained in the gaseous fraction depleted in hydrocarbons obtained from the stripping zone is sent to a drying-desulphurising zone from which substantially pure and substantially dry hydrogen is recovered, and the other portion is recovered without complementary treatment.

The hydrogen from a gaseous mixture containing hydrogen and hydrogen sulphide from the stripping zone is normally purified using one or other of the conventional techniques which are well known to the skilled person and in particular by a prior treatment of this gaseous mixture with a solution of at least one amine under conditions which can eliminate hydrogen sulphide by absorption, said amine usually being selected from the group formed by monoethanolamine, diethanolamine, diglycolamine, diisopropylamine and methyldiethanolamine. In a particular implementation of this absorption, the gaseous mixture is brought into contact with a basic solution, preferably an aqueous solution of an amine selected from the group mentioned above, which forms an addition compound with the hydrogen sulphide and which can produce a purified gas containing proportions of hydrogen sulphide which are much lower than 500 ppm by weight and usually less than about 100 ppm by weight.

Usually the quantity of hydrogen sulphide remaining is less than about 50 ppm by weight and more usually less than about 10 ppm by weight. This method for purifying a gaseous mixture is a conventional method which is well known to the skilled person and which has been widely described in the literature. It has, for example, been succinctly described for treating natural gas containing hydrogen sulphide in Ullmann's Encyclopaedia volume A12 pages 258 ff. In the present invention, the treatment with an aqueous diamine solution is normally carried out at a temperature of about 10° C. to about 100° C. and usually about 20° C. to about 70° C. The quantity of amine used is normally such that the hydrogen sulphide to amine mole ratio is about 0.11:1 to about 1:1 and usually about 0.3:1 to about 0.8:1, for example about 0.5:1. The pressure at which the hydrogen sulphide is absorbed by the amine solution is normally about 0.1 MPa to about 50 MPa, usually about 1 MPa to about 25 MPa and usually about 1 MPa to about 10 MPa. The amine solution is conventionally regenerated by varying the pressure. To obtain a dryer gas and better elimination of the hydrogen sulphide initially present in the gaseous mixture, it is also possible to carry out a complementary treatment on at least a portion of this gaseous mixture, such as treating the gas leaving the absorption step in a hydrogen sulphide adsorption zone comprising at least one reactor and normally at least two adsorption reactors containing a sieve, for example, preferably a regeneratable sieve or, for example, zinc oxide, and operating, for example, at a temperature of about 10° C. to about 400° C., normally about 10° C. to about 100° C. and usually about 20° C. to about 50° C. at a total pressure of about 0.1 MPa to about 50 MPa, usually about 1 MPa to about 25 MPa and preferably about 1 MPa to about 10 MPa. In this implementation, when the adsorption zone comprises two reactors, one reactor is used to treat the gas while the other is being regenerated or the material it contains is being replaced, to dry and desulphurise the gaseous mixture entering said zone. At the outlet from this complementary treatment, the hydrogen sulphide content of the gas is normally less than 1 ppm by weight and usually of the order of a few tens of ppb by weight.

In one implementation, the gaseous effluent formed in the stripping step is cooled by at least one cooling means located inside the stripping zone close to the outlet for said gaseous effluent from said stripping zone.

In a further advantageous implementation, the gaseous effluent formed in the stripping step is cooled by at least one cooling means located outside the stripping zone and is at least partially condensed, at least a portion of the liquid obtained being returned to the stripping zone.

In a further implementation, the gaseous effluent formed in the stripping step is cooled by at least one cooling means, at least a portion of the liquid hydrocarbon fraction obtained being returned to the stripping zone and optionally at least a further portion being sent to hydrodesulphurisation step a) as a mixture with the hydrocarbon feed.

The substantially pure hydrogen recovered after the stripping step is recycled to the stripping zone to at least one introduction point located between the point for introducing a portion of the gas containing hydrogen used for stripping and the point for introducing effluent from hydrodesulphurisation step a) into said stripping zone.

The substantially pure hydrogen recovered after the stripping step is recycled directly, and/or after mixing with the feed, to the hydrodesulphurisation zone of step a).

The substantially pure hydrogen recovered after the stripping step, preferably already dried and deeply desulphurised, is recycled to the hydrotreatment zone of step c) directly and/or after mixing with the liquid effluent from the stripping zone and with the makeup hydrogen.

In a particular implementation of the process of the invention, if it is not wished to dry the whole of the substantially pure hydrogen recovered from the hydrogen sulphide elimination zone, it is advantageous to carry out drying and deep desulphurisation of the hydrogen which is to be recycled to hydrotreatment step c).

In a preferred implementation of the invention, the operating conditions of steps a) and c) are selected as a function of the characteristics of the feed which may be a straight run gas oil, a gas oil cut originating from catalytic cracking or a gas oil from coking or visbreaking of residues or a mixture of two or more of these cuts. They are normally selected so as to obtain a product at the outlet from step a) containing less than 100 ppm of sulphur and less than 200 ppm of nitrogen, preferably less than 100 ppm of nitrogen and usually less than 50 ppm of nitrogen and the conditions of step c) are selected so as to produce a product at the outlet from said step c) containing less than 20% by volume of aromatic compounds. These conditions can be made more severe to obtain, after the second step, a fuel containing less than 10% by volume of aromatic compounds or even less than 5% by volume of aromatic compounds, less than 50 ppm or even less than 10 ppm of sulphur, less than 50 ppm or even less than 20 ppm of nitrogen or more preferably less than 10 ppm and with a cetane number of at least 50 or even at least 55 and usually in the range 55 to 60.

To obtain such results, the conditions of step a) comprise a temperature of about 300° C. to about 450° C., a total pressure of about 2 MPa to about 20 MPa and an overall hourly space velocity of liquid feed of about 0.1 to about 4 and that of step b) is a temperature of about 200° C. to about 400° C., a total pressure of about 3 MPa to about 15 MPa and an hourly space velocity of liquid feed of about 0.5 to about 10.

The catalyst used in step a) contains, on a mineral support, at least one metal or compound of a metal from group VIB of the periodic table in a quantity, expressed as the weight of metal with respect to the weight of finished catalyst, normally about 0.5% to 40%, and at least one metal or compound of a metal from group VIII of said periodic table in a quantity, expressed as the weight of metal with respect to the weight of finished catalyst, normally about 0.1% to 30%. Usually, the catalyst used will contain at least one element selected from the group formed by silicon, phosphorous and boron or compounds of this or these elements. The catalyst will, for example, contain phosphorous or at least one phosphorous compound in a quantity, expressed as the weight of phosphorous pentoxide with respect to the weight of support, of about 0.001% to 20%. The quantity of metal or compound of metal from group VIB, expressed as the weight of metal with respect to the weight of finished catalyst, is preferably about 2% to 30% and usually about 5% to 25%, and that of the metal or metal compound from group VIII will preferably be about 0.5% to 15%, usually about 1% to 10%.

When a relatively low temperature range is desired but excellent results are to be retained, it is possible to carry out a first step a1) under conditions which can reduce the sulphur content of the product to a value of about 500 to 800 ppm then to send this product to a subsequent step a2) in which the conditions are selected to bring the sulphur content to a value of less than about 100 ppm, preferably less than about 50 ppm, and the product from this step a2) is then sent to step b). In this implementation, the conditions of step a2) are milder than when a single step a) is used for a given feed since the product sent to this step a2) already has a reduced sulphur content. In this type of implementation, the catalyst of step a1) can be a conventional prior art catalyst such as that described in the text of the Applicant's French patents FR-A-2 197 966 and FR-A-2 538 813 and that of step a2) is that described above for step a). The scope of the present invention also encompasses using the same catalyst in steps a1) and a2).

In these steps a), a1), a2), the mineral support of the catalyst is preferably selected from the group formed by alumina, silica, silica-aluminas, zeolites and mixtures of at least two of these mineral compounds. Alumina is routinely used.

In a preferred implementation of the invention, the catalyst of these steps a), a1), a2) comprises at least one metal or metal compound selected from the group formed by molybdenum and tungsten and at least one metal or compound of a metal selected from the group formed by nickel, cobalt and iron. This catalyst usually contains molybdenum or a molybdenum compound and at least one metal or metal compound selected from the group formed by nickel and cobalt.

In a particular and preferred implementation of the invention, the catalyst in these steps a), a1), a2) comprises boron or at least one boron compound preferably in a quantity, expressed as the weight of boron trioxide with respect to the weight of the support, of about 0 to 10%. Other implementations are also frequently used and in this case, for example, the catalyst comprises a silicon or a silicon compound, or a combination of silicon and boron or compounds of each of these elements, optionally combined with phosphorous or a phosphorous compound. Non limiting examples of specific combinations containing these elements or compounds of these elements which can be cited are: Ni—Mo—P, Ni—Mo—P—B, Ni—Mo—Si, Ni—Mo—Si—B, Ni—Mo—P—Si, Ni—Mo—Si—B—P, Co—Mo—P, Co—Mo—P—B, Co—Mo—Si, Co—Mo—Si—B, Co—Mo—P—Si, Co—Mo—Si—B—P, Ni—W—P, Ni—W—P—B, Ni—W—Si, Ni—W—Si—B, N—W—P—Si, Ni—W—Si—B—P, Co—W—P, Co—W—P—B, Co—W—Si, Co—W—Si—B, Co—W—P—Si, Co—W—Si—B—P, Ni—Co—Mo—P, Ni—Co—Mo—P—B, Ni—Co—Mo—Si, Ni—Co-Mo—Si—B, Ni—Co—Mo—Si—P.

The catalyst used in step c) contains, on a mineral support, at least one noble metal or a compound of a noble metal from group VIII of the periodic table in a quantity, expressed as the weight of metal with respect to the weight of finished catalyst, of about 0.01% to 20%, and preferably at least one halogen. The mineral support of the catalyst used in step c) is selected independently of the support used for the catalyst of step a). The catalyst of step c) usually comprises at least one metal or compound of a noble metal selected from the group formed by palladium and platinum.

The mineral support of the catalyst used in step c) is usually selected from the group formed by alumina, silica, silica-aluminas, zeolites and mixtures of at least two of these mineral compounds. This support preferably comprises at least one halogen selected from the group formed by chlorine, fluorine, iodine and bromine, preferably from the group formed by chlorine and fluorine. In an advantageous implementation, this support comprises chlorine and fluorine. The quantity of halogen is usually about 0.5% to 15% by weight with respect to the weight of the support. The support which is most frequently used is alumina. The halogen is normally introduced into the support from the corresponding acid halides and the platinum or palladium from aqueous solutions of their salts or compounds, such as hexachloroplatinic acid in the case of platinum.

The quantity of metal of this catalyst of step c) is preferably about 0.01% to 10%, normally about 0.01% to 5% and usually about 0.03% to 3%, expressed as the weight of metal with respect to the finished catalyst.

Figure 2:
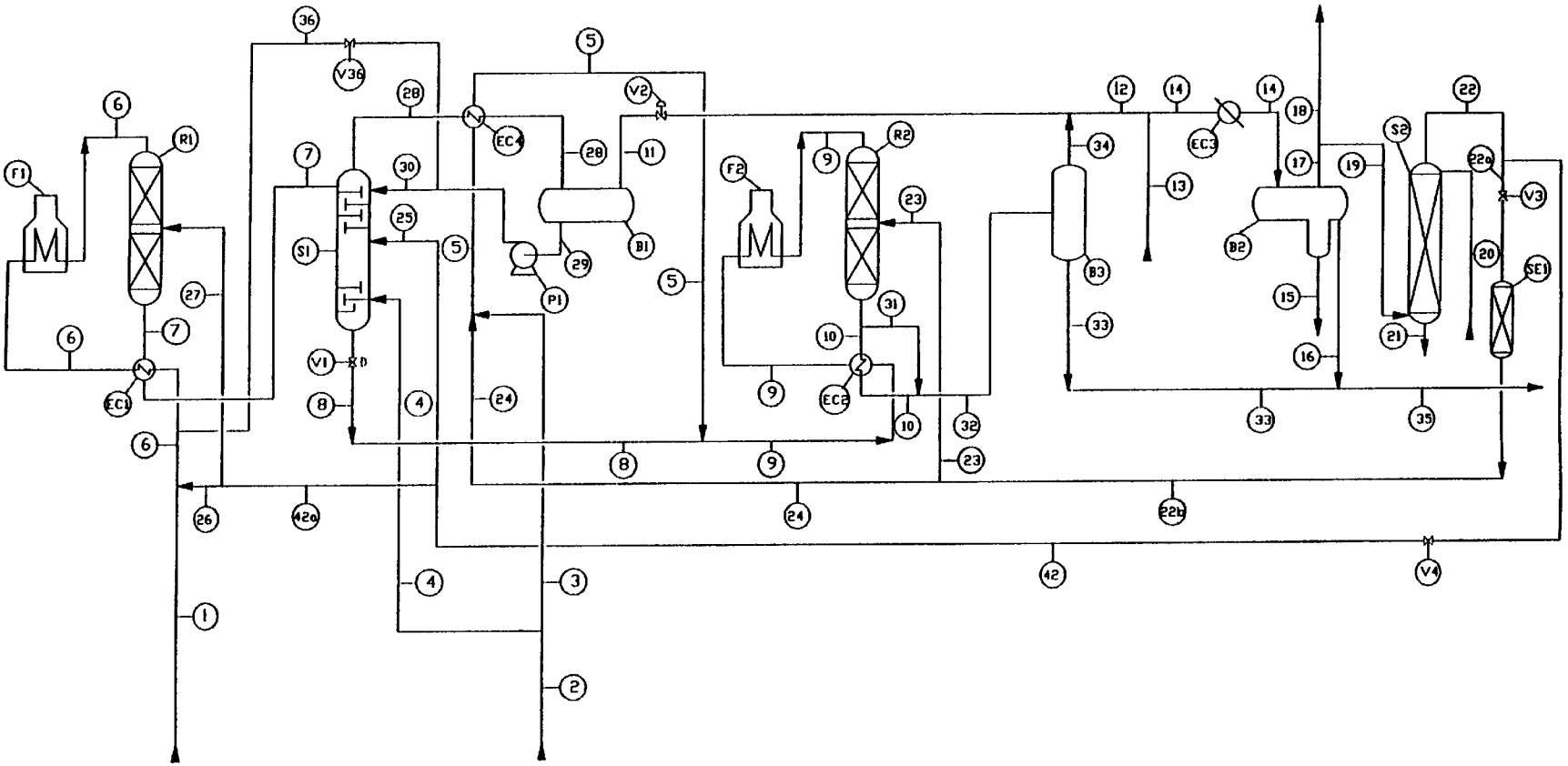
Figure 3:
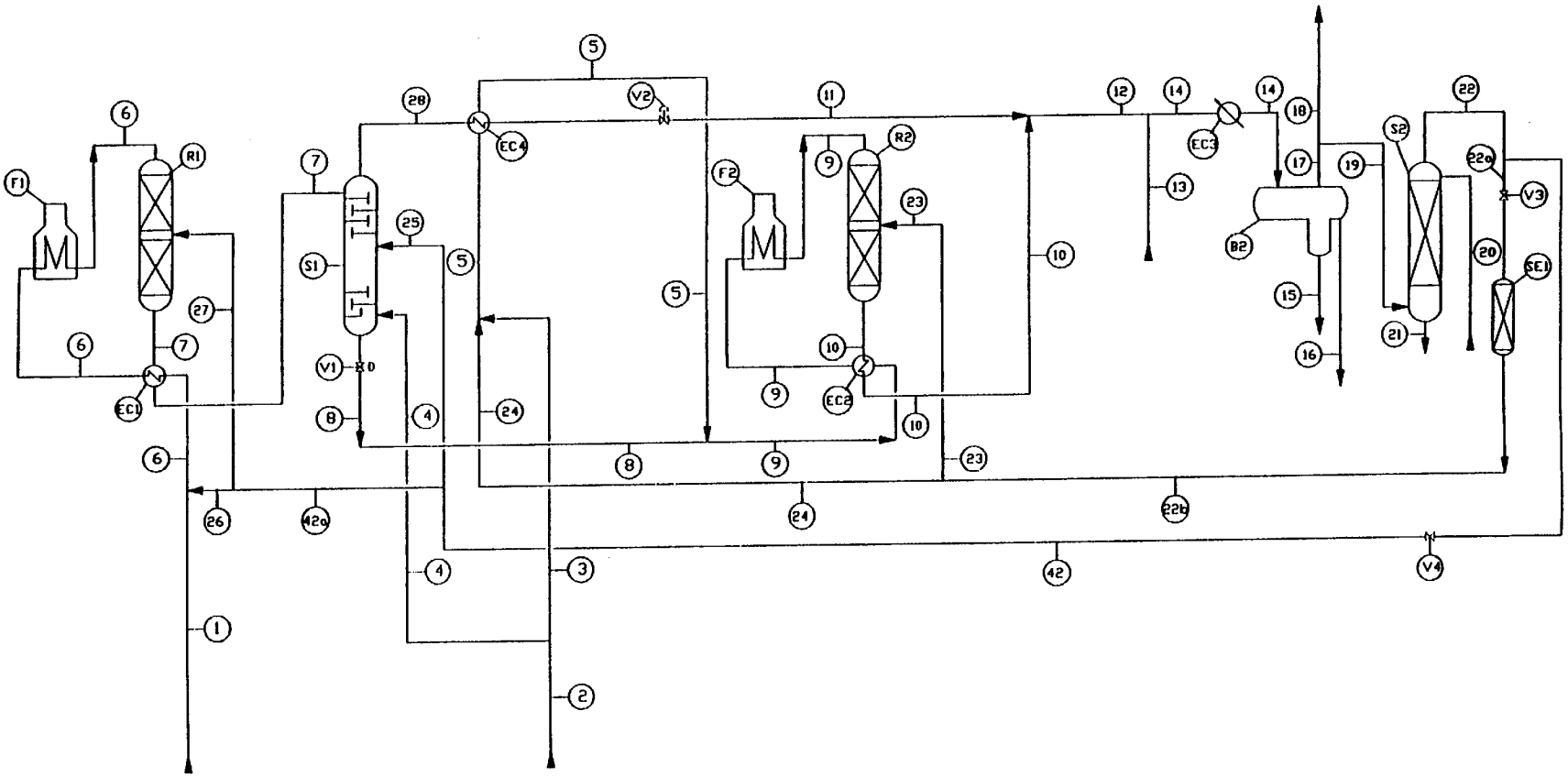

FIGS. 1 and 2 briefly illustrate two implementations of the process of the invention and FIG. 3 illustrates a prior art process. Similar means on these figures are designated by the same reference letters and numerals.

The hydrocarbon feed arriving via line 1 is mixed with substantially pure hydrogen arriving via lines 42, 42*a* and 26, then this mixture is introduced into reactor R1 via line 6 after exchanging heat with the effluent from reactor R1 in heat exchanger EC1 and after having been pre-heated in furnace F1. Hydrogen arriving via lines 42 and 42*a* is introduced into reactor R1 via line 27 as a cooling gas (quench). The effluent leaving reactor R1 is sent via line 7, after exchanging heat in exchanger EC1 with the hydrocarbon feed to stripper S1 in which it is purified by a portion of the makeup hydrogen arriving via lines 2 and 4. Substantially pure recycled hydrogen is also introduced into stripper S1 via lines 42 and 25. The gaseous effluent leaving stripper S1 via line 28 exchanges heat in exchanger EC4 located on line 5 with a mixture of hydrogen recycled via line 24 and makeup hydrogen introduced via lines 2, 3 and 5. Said mixture is then introduced into reactor R2 via line 9. The condensed liquid hydrocarbon fraction entering into separator drum B1 via line 28 leaves via line 29 and a portion is returned by means of pump P1 via line 30 to stripper S1 and optionally a portion is returned via line 36 through a valve V36 and line 6 to reactor R1. The liquid fraction leaving stripper S1 traverses control valve V1 then is sent to reactor R2 via lines 8 and 9, after mixing with hydrogen arriving via line 5, having exchanged heat in exchanger EC2 with the effluent leaving reactor R2 via line 10 and after having been re-heated in furnace F2. If the pressure of the fluid leaving stripper S1 via line 8 is lower than that prevailing in reactor R2, a pump is used to adjust this pressure to a level at least equal to that of the pressure prevailing in reactor R2. Hydrogen arriving via lines 22, 22*a*, 22*b* and 23 is introduced into reactor R2 as a quench. The gaseous effluent leaving the separator drum B1 via line 11 traverses pressure regulating valve V2 then is mixed with the effluent from reactor R2 arriving via line 10, before being sent via lines 12 and 14, after mixing with washing water arriving via line 13 and heat exchange in exchanger EC3, to a separator drum B2 from which an aqueous fraction is recovered via line 15, a liquid hydrocarbon fraction constituting the desired partially desulphurised and dearomatised effluent is recovered via line 16, and a gaseous fraction is recovered via line 17, containing hydrogen and hydrogen sulphide a portion of which can optionally be purged via line 18 which includes a valve V18 (not shown in the figures), to adjust the purge flow rate, hydrogen leaks constituting the minimal purge counted on line 18) and a further portion, or all when there is no purge, is sent via line 19 to an absorber S2 to eliminate at least a portion of the hydrogen sulphide, into which an absorption solution is introduced via line 20 and recovered via line 21. At least a portion of purified hydrogen is recovered via line 22 and 22a which can be sent via flow regulation valve V3 to drying-desulphurising zone SE1 then recycled to reactor R2 via lines 22*b* and 23. A further portion of purified hydrogen recovered via line 22 is sent via lines 42 and 25 through flow rate regulation valve V4 to stripper S1 and/or via lines 42, 42*a*, 26 and 6 to reactor R1. Although not shown on the figures, line 42*a* normally includes a valve V40 (not shown in the figures) for regulating the flow rate of purified hydrogen which is sent to reactor R1. Although not shown on the figures, the optional recycle of hydrogen leaving adsorber S2 to be sent to reactor R2 via lines 22, 22*a*, 22*b* and 23 and/or 22, 22*a*, 24 and 5 necessitates the use of a compressor to adjust the pressure to a level at least equal to the pressure prevailing in this reactor R2. This is the same for the hydrogen leaving absorber S2 which is optionally recycled to stripper S1 and/or to reactor R1. Thus a single compressor can be used to obtain a gas at the pressure required for the various recycles envisaged. In this case, this compressor is located close to adsorber S2 on line 22. It is also possible to use two compressors, one located on line 22*b* and the other located on line 42.

FIG. 2 shows the case where only a portion of the effluent leaving reactor R2 via line 10 is cooled in heat exchanger EC2, a further portion is sent via line 31 after mixing with the portion which has exchanged heat via line 32 to hot separator B3 from which a gas is recovered via line 34 which is mixed with the gas arriving via line 11 and via line 33, a liquid hydrocarbon fraction constituting a portion of the desired partially desulphurised and dearomatised effluent which is mixed with the hydrocarbon fraction leaving separator drum B2 via line 16 to obtain the desired desulphurised and dearomatised effluent which is recovered via line 35.

FIG. 3 illustrates the prior art and is to be directly compared with the diagram of FIG. 1 illustrating the present invention from which it differs in two essential points. Stripper S1 used does not include a drum for recovering a liquid fraction and thus the heavy hydrocarbons which are entrained in the gas leaving stripper S1 overhead is not reintroduced into this stripper. As there is no recovery of heavy hydrocarbons entrained overhead in stripper S1, there is no introduction of a fraction of these heavy hydrocarbons into reactor R1.

The following examples illustrate the invention without limiting its scope.

The common data in the three examples were extracted from computer simulations created using PGGC software from pilot unit results,

| Feed: | | |
|---|---|---|
| Flow rate | t/h | 100 |
| Density at 15° C. | kg/m$^3$ | 852 |
| Sulphur content | % by weight | 1.44 |
| Nitrogen content | % by weight | 0.011 |
| Aromatics content | % by weight | 30 |
| Distillation | | |
| 5% volume | ° C. | 253 |
| 50% volume | ° C. | 306 |
| 95% volume | ° C. | 386 |

Makeup composition:
Hydrogen: 99.9% by volume
Methane: 0.1% by volume

Operating conditions:

| | Absolute pressure MPa | Temperature ° C. |
|---|---|---|
| Reactor outlet R1 | 6.4 | 350 |
| Feed S1 | | 255 |
| Outlet reactor R2 | 5.7 | 310 |
| Drum B2 | 5.5 | 40 |

Space velocity
Reactor R1: 1 m$^3$/(m$^3$/h)
Reactor R2: 2 m$^3$/(m$^3$/h)

EXAMPLE 1

The summary table following the description of the three examples shows the flow rates of the different streams.

In accordance with the diagram of FIG. 1, feed arriving via line 1 was mixed with recycled gas from line 26, and this mixture was introduced into reactor R1 via line 6, at a pressure of 6.6 MPa and at a temperature of 330° C., after having been heated in exchanger EC1 and furnace F1. The increase in temperature in the reactor was limited to a range of 20° C. using a hydrogen gas quench arriving via line 27. The effluent from reactor R1 was sent via line 7, after cooling in exchanger EC1, to the top plate of the hydrogen stripper S1 The overhead product from the hydrogen stripper was quenched, the quenching range being 55° C., and was sent via line 28 to drum B1. The liquid from this drum was returned via lines 29 and 30 and pump P1 to the overhead plate for the hydrogen stripper while the vapour was sent via line 11 through the pressure regulating valve V2 to drum B2 with the effluent from reactor R2 after mixing in line 12. This overhead vapour contained about 2295 kg/h of product in the gas oil cut which was not treated in the hydrogenation reactor.

Stripping hydrogen was injected into about the middle of the hydrogen stripper via line 25 to strip the majority of the hydrogen sulphide and makeup hydrogen was injected via line 4 into the bottom of the stripper to complete stripping of the hydrogen sulphide in the liquid feed which was sent to the hydrogenation reactor R2 via line 8.

The flow rate of this liquid feed was controlled by control valve V1 then it was mixed with makeup hydrogen from line 3 and recycled hydrogen from line 24. This mixture was sent to reactor R2 via exchanger EC2 and furnace F2 via line 9 to reach the temperature required to enter the reactor.

The increase in temperature in treatment R2 was controlled by injecting a hydrogen quench via line 23.

The effluent from reactor R2 was withdrawn via line 10 then it was mixed with the vapour from the head of the stripper in line 12. In this mixture, upstream of exchanger EC3, a certain quantity of washing water was injected to eliminate the ammonium sulphide formed in the reactors. After partial condensation in exchanger EC3, the three phases present were separated in drum B2.

The hydrocarbon phase constituting the product of the process was sent via line 16 to a subsequent treatment for extracting the residual hydrogen sulphide and eliminating light fractions.

The aqueous phase was withdrawn via line 15 for sending to waste water treatment.

The vapour phase left drum B2 via line 17 and was sent via line 19 to amine wash S2 while the excess hydrogen could be purged via line 18. A portion of the hydrogen gas, purified of hydrogen sulphide by the amine wash, was separated into different streams:

recycle to R1, line 26;

quench to R1, line 27;

stripping gas to S1, line 25.

A further portion of this gas was dried and desulphurised in reactor SE1 and separated into different streams:

recycle to R2 line 24;

quench to R2, line 23.

An amine solution, depleted in hydrogen sulphide, was sent to the head of the washing column via line 20 while the hydrogen sulphide-rich solution was sent to an amine regeneration section via line 21.

| | | |
|---|---|---|
| Flow rate | t/h | 98.6 |
| Density at 15° C. | kg/m$^3$ | 822 |

-continued

| | | |
|---|---|---|
| Sulphur content | % by weight | <0.0010 |
| Nitrogen content | % by weight | <0.0010 |
| Aromatics content | % by weight | 1.5 |
| Distillation | | |
| 5% volume | ° C. | 240 |
| 50% volume | ° C. | 294 |
| 95% volume | ° C. | 376 |

EXAMPLE 2

The summary table following the description of the three examples shows the flow rates of the different streams.

In the diagram of FIG. 2, the description is identical to the corresponding description for FIG. 1 until the outlet of the effluent from reactor R2, line 10, after cooling in exchanger EC2. This effluent was sent via line 32 to hot separator drum B3 at a pressure of 5.5 MPa and at a temperature of 270° C.

The vapour phase from drum B3, line 34, was mixed in line 12 with the overhead product from the hydrogen stripper, line 11. In this mixture, upstream of exchanger EC3, a certain quantity of washing water was injected via line 13 to eliminate the ammonium sulphide formed in the reactors. After partial condensation in exchanger EC3, the three phases present were separated in drum B2.

The hydrocarbon phase, line 16, was mixed in line 35 with the liquid from drum B3, line 33, to constitute the product of the process which was sent to a subsequent treatment for extracting residual hydrogen sulphide and eliminating the light fractions.

The aqueous phase was withdrawn via line 15 and sent to waste water treatment.

The vapour phase left drum B2 via line 17 and was treated as described for FIG. 1 above.

| | | |
|---|---|---|
| Flow rate | t/h | 98.6 |
| Density at 15° C. | kg/m$^3$ | 823 |
| Sulphur content | % by weight | <0.0010 |
| Nitrogen content | % by weight | <0.0010 |
| Aromatics content | % by weight | 1.8 |
| Distillation | | |
| 5% volume | ° C. | 240 |
| 50% volume | ° C. | 294 |
| 95% volume | ° C. | 376 |

EXAMPLE 3

The summary table following the description of the three examples shows the flow rates of the different streams.

The diagram of FIG. 3, with no condensation of heavy hydrocarbons overhead of the hydrogen stripper S1, is identical to that of Example 1 with the exception that the condensates at the head of the hydrogen stripper were not recovered in Example 3.

Referring to the table indicating the flow rates of the different streams, it should be noted that for this example, 3659 kg/h of heavy products were not recovered with respect to Example 1. These heavy products could not be treated in reactor R2; thus to obtain the same quality of the final product, the treatment in the reactor R2 had to be more severe in Example 3 than in Example 1.

| | | |
|---|---|---|
| Flow rate | t/h | 98.6 |
| Density at 15° C. | kg/m$^3$ | 830 |
| Sulphur content | % by weight | <0.0010 |
| Nitrogen content | % by weight | <0.0010 |
| Aromatics content | % by weight | 2 |
| Distillation | | |
| 5% volume | ° C. | 240 |
| 50% volume | ° C. | 294 |
| 95% volume | ° C. | 376 |

| Stream name | Stream | Example 1 kg/h | Example 2 kg/h | Example 3 kg/h |
|---|---|---|---|---|
| Feed R1 | 1 | 10000 | 100000 | 100000 |
| Recycle H2 to R1 | 26 | 3452 | 4281 | 3451 |
| Quench H2 to R1 | 27 | 3380 | 3772 | 3379 |
| Makeup H2 to S1 | 3 | 277 | 277 | 277 |
| Recycle H2 to S1 | 25 | 556 | 556 | 556 |
| Vapour to drum B2 | 11 | 12355 | 13470 | 16150 |
| Heavy to drum B2 | 11 | 2294 | 2333 | 5953 |
| Bottom S1 (feed | 8 | 95310 | 95416 | 91513 |
| Makeup H2 to R2 | 3 | 1079 | 1144 | 1063 |
| Recycle H2 to R2 | 24 | 2239 | 2667 | 2318 |
| Quench H2 to R2 | 23 | 1740 | 1933 | 1659 |
| Vapour B3 | 34 | n.a. | 10345 | n.a. |
| Liquid B3 | 33 | n.a. | 90815 | n.a. |
| Supply B2 | 14 | 112723 | 23815 | 112704 |
| Washing water | 13 | 1585 | 1585 | 1585 |
| Acid water drum B2 | 15 | 1651 | 1651 | 1651 |
| Hydrogen purge | 18 | 158 | 185 | 158 |
| Hydrocarbon drum B2 | 16 | 99664 | 8652 | 99648 |
| Product | 35 | 99664 | 99467 | 99648 |

What is claimed is:

1. A process for hydrotreating a hydrocarbon feed containing sulphur-containing compounds, nitrogen-containing compounds and aromatic compounds, comprising the following steps:

a) at least one first step comprising passing said feed and hydrogen into a hydrodesulphurisation zone containing at least one hydrodesulphurisation catalyst comprising, on a mineral support, at least one metal or compound of a metal from group VIB of the periodic table and at least one metal or compound of a metal from group VIII of said periodic table, said zone being maintained under hydrodesulphurisation conditions including a temperature of about 260° C. to about 450° C. and a pressure of about 2 MPa to about 20 MPa;

b) at least one second step comprising sending the partially desulphurised feed from the first hydrodesulphurisation step to a stripping zone in which it is purified by stripping with a counter-current stream of at least one gas containing hydrogen at a pressure substantially identical to that prevailing in the first step and at a temperature of about 100° C. to about 350° C. under conditions for formation of a gaseous stripping effluent containing hydrogen and hydrogen sulphide and a liquid feed containing substantially no hydrogen sulphide; and c) at least one third step comprising, after adding substantially pure makeup hydrogen and recycled hydrogen, sending the liquid feed from the stripping step to a hydrotreatment zone containing a hydrotreatment catalyst comprising, on a mineral support, at least one noble metal or compound of a noble metal from group VIII, maintaining said zone under hydrotreatment conditions to obtain a partially dearomatised effluent;

wherein cooling the gaseous effluent formed in the stripping step, containing hydrocarbons which are gaseous under the conditions in said stripping zone, hydrogen and hydrogen sulphide, to a temperature sufficient to form a liquid hydrocarbon fraction, and sending directly at least a portion of the liquid hydrocarbon fraction to the stripping zone (b) and sending a gaseous fraction which is depleted in hydrocarbons to a zone for eliminating the hydrogen sulphide it contains and from which purified hydrogen is recovered.

2. A process according to claim 1, in which, after adding substantially pure makeup hydrogen and recycled hydrogen, the liquid effluent from the stripping step is sent to a hydrotreatment zone containing a hydrotreatment catalyst comprising, on a mineral support, at least one noble metal or compound of a noble metal from group VIII after having been heated by direct heat exchange to a temperature of about 220° C. to about 360° C. and a pressure of about 2 MPa to about 20 MPa, said zone being maintained under hydrotreatment conditions to produce a partially dearomatised effluent.

3. A process according to claim 1, in which a fraction of the makeup hydrogen is used in stripping step b) as a hydrogen-containing stripping gas.

4. A process according to claim 1, in which the operating conditions of step a) are selected so as to obtain a product containing less than 100 ppm of sulphur and less than 200 ppm of nitrogen and the conditions of step c) are selected so as to obtain a product containing less than 20% by volume of aromatic compounds.

5. A process according to claims 1, in which the gaseous effluent formed in the stripping steps (b) is cooled by at least one cooling means located inside the stripping zone close to the outlet for said gaseous effluent from said stripping zone.

6. A process according to claims 1, in which the gaseous effluent formed in the stripping step (b) is cooled by at least one cooling means located outside the stripping zone and is at least partially condensed, the liquid obtained being sent to the stripping zone.

7. A process according to claim 1, in which at least a portion of the purified hydrogen obtained from an outlet from the zone for eliminating the hydrogen sulphide it contains is sent to a drying-desulphurising zone.

8. A process according to claim 1, in which at least a portion of a substantially pure hydrogen recovered after the stripping step is recycled to the stripping zone into at least one introduction point located between the point for introducing a portion of the hydrogen-containing gas used for stripping and the point for introducing effluent from hydrodesulphurisation step a) into said stripping zone.

9. A process according to claim 1, in which at least a portion of a substantially pure hydrogen recovered after the stripping step is recycled directly and/or after mixing with the feed to the hydrodesulphurisation zone of step a).

10. A process according to claim 1, in which at least a portion of a substantially pure hydrogen recovered after the stripping step is recycled directly and/or after mixing with the liquid effluent from the stripping zone and with the makeup hydrogen to the hydrotreatment zone of step c).

11. A process according to claim 1, in which the catalyst from step a) comprises at least one metal or compound of a metal selected from the group formed by molybdenum and tungsten and at least one metal or compound of a metal selected from the group formed by nickel, cobalt and iron.

12. A process according to claim 1, in which the catalyst from step a) further comprises at least one element selected from the group formed by silicon, phosphorous and boron, or at least.one compound comprising at least one of silicon, phosphorous, or boron.

13. A process according to claims 1, in which the catalyst of step a) further comprises phosphorous or at least one phosphorous compound.

14. A process according to claim 1, in which the catalyst of step a) further comprises boron or at least one boron compound.

15. A process according to claim 1, in which the catalyst of step a) further comprises silicon or at least one silicon compound.

16. A process according to claim 1, in which the support for the catalysts used in step a) and in step c) are selected independently of each other from the group formed by an alumina, a silica, a silica-alumina, a zeolite and a mixture thereof.

17. A process according to claim 1, in which the support for the catalyst of step c) comprises at least one halogen.

18. A process according to claim 1, in which the catalyst for step c) comprises at least one nobel metal or compound of a noble metal selected from the group formed by palladium and platinum.

19. A process according to claim 1, in which at least a portion of the liquid hydrocarbon fraction obtained by quenching the gaseous effluent from the stripping zone is sent as a mixture with the hydrocarbon feed to hydrodesulphurisation step a).

20. A process according to claim 1, wherein the support for the catalyst of step c) comprises chlorine or fluorine.

* * * * *